US009669445B2

(12) United States Patent
Nillies

(10) Patent No.: US 9,669,445 B2
(45) Date of Patent: Jun. 6, 2017

(54) METHOD AND DEVICE FOR RESHAPING A WORKPIECE BY DISPLACING MATERIAL IN THE WORKPIECE

(71) Applicant: Leifeld Metal Spinning AG, Ahlen (DE)

(72) Inventor: Benedikt Nillies, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 208 days.

(21) Appl. No.: 14/394,529

(22) PCT Filed: Mar. 5, 2013

(86) PCT No.: PCT/EP2013/054388

§ 371 (c)(1),
(2) Date: Oct. 15, 2014

(87) PCT Pub. No.: WO2013/156193

PCT Pub. Date: Oct. 24, 2013

(65) Prior Publication Data

US 2015/0089986 A1 Apr. 2, 2015

(30) Foreign Application Priority Data

Apr. 20, 2012 (EP) ..... 12002781

(51) Int. Cl.
*B21D 22/21* (2006.01)
*B21D 53/26* (2006.01)
*B21D 22/14* (2006.01)

(52) U.S. Cl.
CPC ..... *B21D 22/21* (2013.01); *B21D 22/14* (2013.01); *B21D 53/261* (2013.01)

(58) Field of Classification Search
CPC ..... B24B 39/045; B24B 39/04; B24B 39/003; B24B 39/023; B21H 1/04; B21H 1/12;
(Continued)

(56) References Cited

U.S. PATENT DOCUMENTS 3,120,206 A 2/1964 Sporck
5,031,296 A * 7/1991 Magnoni ..... B21D 53/261 29/33 R
5,619,879 A 4/1997 Friese

FOREIGN PATENT DOCUMENTS

CN 101342554 A 1/2009
CN 101528376 A 9/2009
(Continued)

OTHER PUBLICATIONS

International Search Report dated Jun. 26, 2013 issued in corresponding application No. PCT/EP2013/054388.
(Continued)

*Primary Examiner* — Peter DungBa Vo
*Assistant Examiner* — John S Lowe
(74) *Attorney, Agent, or Firm* — Westerman, Hattori, Daniels & Adrian, LLP

(57) ABSTRACT

The invention relates to a method for reshaping a workpiece comprising a central axis, a radial inner region, and a radial outer region, in which the radial inner region of said workpiece is reshaped by means of a punch and a die by a drawing operation in the axial direction with formation of an axial shaped section. Provision is made for the workpiece, the die, and the punch to be rotated about the central axis during the reshaping process by a drawing operation and for the radial outer region of said workpiece to be subjected, during reshaping by a drawing operation of the rotating workpiece, to the action of at least one shaping roller such that a flow of material in the direction of the radial inner region of said workpiece is caused or aided. The invention further relates to a device for reshaping a workpiece.

17 Claims, 15 Drawing Sheets

(58) Field of Classification Search
CPC ... B21H 5/02; B21H 1/02; B21H 1/10; B21H 5/00; B21H 1/00; B21H 7/182; Y10T 29/4946; Y10T 29/477; Y10T 29/49453; Y10T 29/49458; Y10T 29/49991; B21D 17/04; B21D 22/21; B21D 22/14
USPC ..... 72/110
See application file for complete search history.

(56) References Cited

FOREIGN PATENT DOCUMENTS

| | | | |
|---|---|---|---|
| DE | 44 00 257 | C1 | 12/1994 |
| DE | 43 27 746 | A1 | 2/1995 |
| DE | 100 61 403 | A1 | 6/2002 |
| EP | 0639415 | A2 | 2/1995 |
| EP | 0 997 210 | A2 | 5/2000 |
| EP | 1 136 150 | A2 | 9/2001 |
| JP | H08-174114 | A | 7/1996 |
| JP | 2000-233249 | A | 8/2000 |
| JP | 2002-122209 | A | 4/2002 |
| JP | 2002-122210 | A | 4/2002 |
| JP | 2004-025279 | A | 1/2004 |
| JP | 2007-253331 | A | 10/2007 |
| JP | 2008-260042 | A | 10/2008 |
| JP | 2010-214449 | A | 9/2010 |

OTHER PUBLICATIONS

International Preliminary Report on Patentability (form PCT/IB/373) of International Application No. PCT/EP2013/054388, mailing date of Oct. 21, 2014, with Written Opinion (form PCT/ISA/237) (6 pages).

Office Action dated Dec. 22, 2016, issued in counterpart Japanese Application No. 2015-506133, with English translation. (5 pages).

* cited by examiner

METHOD AND DEVICE FOR RESHAPING A WORKPIECE BY DISPLACING MATERIAL IN THE WORKPIECE

The invention relates to a method and a device for reshaping a workpiece according to the generic clauses of claims 1 and 11.

The workpiece to be reshaped comprises a central axis, a radial inner region, and a radial outer region. In the method, the radial inner region of the workpiece is reshaped by means of a punch and a die by drawing in the direction of the axis. This forms an axially shaped section.

The device comprises a die and a punch for reshaping the radial inner region of the workpiece by means of drawing.

Many shapes can be manufactured by means of the reshaping method and the device described by means of so-called a drawing or deep-drawing process. This usually results in a reduction in the diameter of the workpiece. The stresses that occur during reshaping, in particular the radial tension stress and the tangential compressive stress, result in a particularly complex flow of material.

The shapes manufactured by means of drawing or deep-drawing usually comprise a radial flange section and an axial shape section. The axial shape section is, in particular, to be understood herein as a section of the workpiece that projects away from the level of the radial flange section.

The edge or transition between the radial flange section and the axial shape section is a known weak point when reshaping is carried out by means of deep-drawing. Weakening of the material often occurs in this region, leading at worst to a tear in the material. For example, it is known that excessive weakening of the material can be avoided during reshaping process by heating the workpiece, by the use of relatively large bending radii in the transition area and/or by carrying out the drawing process in a number of stages.

Bowls, for example, may be manufactured by means of drawing or deep-drawing. Shaping by means of deep-drawing requires high axial pressing forces.

A further field of application for drawing or deep-drawing is the manufacture of gearing components having central hubs. The method is used, for example, in the manufacture of belt pulleys or disk carriers. This involves, firstly, the manufacture of a preliminary shape comprising a hub, which preliminary shape is then further shaped on a flow-forming machine or on a spinning machine. Manufacture of a disk carrier by deep-drawing a workpiece is described for example in DE 43 27 746 A1.

In an alternative method for creating a hub in a circular blank sheet as starting workpiece, an outer region of the workpiece is reshaped by means of a pressure roller, and the material gained therefrom is shaped into a cylindrical projection about a tooling pin, which pin passes through the workpiece. DE 44 00 257 C1, for example, describes this method for the manufacture of a gearing component having a hub.

EP 0 997 210 A2 describes a method for shaping a hub by means of a roller having a cutting edge adapted to act on the peripheral region of the workpiece. The material separated from the peripheral region is shaped into a hub within an enclosing chamber of the roller.

With hub manufacture by means of pressure or splitting, there are limitations with regard to the wall thickness and design of the hub.

It is an object of the present invention to provide a device and a method for reshaping a workpiece, allowing for reshaping in a particularly economical and efficient way.

According to the present invention, this object is achieved by a method displaying the features disclosed in claim 1 and by a device displaying the features disclosed in claim 11. Preferred embodiments are stated in the appropriate dependent claims.

The method of the invention is characterized in that, during reshaping of the workpiece by drawing, the workpiece is rotated about its central axis, and as the workpiece rotates, its radial outer region is subjected to the action of at least one shaping roller such that a flow of material is induced or aided in the direction of the radial inner region of the workpiece.

The device is so designed, in accordance with the invention, that the die and the punch are mounted for rotation and that a shaping roller is provided which is adapted to act on a radial outer region of the workpiece while the workpiece is being reshaped by drawing, which action causes a flow of material in the direction of the radial inner region of the workpiece.

A fundamental idea of the invention is to effect or to aid the displacement of material during the drawing process from the radial outer region to the radial inner region by means of the shaping roller. The reshaping or the action of the shaping roller on the radial outer region of the workpiece can take place in such a way that a targeted flow of material moving radially inwardly can be created, that is to say, that the material is forced to move inwardly.

The material flow created by the reshaping roller aids the material flow of the drawing process. The weakening of the material at the edge between the radial inner region reshaped by drawing and the radial outer region of the workpiece is substantially reduced. The method and the device are thus particularly suitable for the manufacture of gearing components, for example hubs, pulleys, disk carriers, or torsional vibration dampers, which are subjected to heavy loading at precisely this transition point. In addition, without weakening the material it is possible to shape smaller radii at said transition point or edge. Further, the subsequent inward movement of material makes it possible to reduce the necessary pressing forces between the punch and the die. Furthermore, the action of the reshaping roller can contribute to a reduction in tension in the radial outer region and thus to a reduction of wave formation.

A further advantage of the method of the invention is that reshaping of the peripheral region by means of the reshaping roller can be effected a high degree of cold hardening of the material. This is conducive to the economical manufacture of a particularly resilient component.

Reshaping of the radial inner region by drawing permits, in addition, a largely free design, in which case contours that may not necessarily show rotational symmetry, such as polygonal contours or corrugations, can be shaped. The improved flow of material makes it possible to manufacture complex workpiece shapes.

The workpiece to be reshaped can, in particular, consist of flat material, in particular a sheet metal plate, of which its primary dimension is at right angles to or radial to the central axis. For example, the workiece can be a round blank. The untreated workpiece is preferably at least substantially rotationally symmetrical in relation to the central axis.

The process of drawing the workpiece preferably takes place in a drawing gap between the punch and the die. To this end, the die has a central free space or intake chamber, into which the punch is driven in order to reshape the workpiece by drawing. Reshaping takes place by driving the punch coaxially into the intake chamber of the die.

According to the invention, the workpiece is for at least a certain processing of time simultaneously subjected to the action of the drawing process by way of the punch and die and to the action by means of the shaping roller. Thus the device is configured so as to provide simultaneous treatment of the workpiece by means of the die and punch as well as by the shaping roller.

The process of drawing the workpiece creates a section, termed as axial shape section, which projects from the plane of the workpiece or of the radial outer region. The axial shape section can comprise, for example, a ring shaped wall, in particular a cylindrical or conical wall, which extends around the central axis of the workpiece. With the creation of the axial shaped section there is formed a radial outer region at the radial periphery of the workpiece, termed as the flange section.

The shaping roller can, in particular, be a pressure roller or a spinning roller. Action on the workpiece reduces the thickness of the radial outer region and the material displaced in this way is forced inwardly. Reshaping takes place as the workpiece rotates. Use may also be made of a profiling roller for thickening or upsetting the material, and this roller is preferably advanced radially.

Basically, it may be sufficient to create only an axial pressure force by means of the shaping roller so as the material is forced to move radially inwardly. However, a more effective redistribution of material is achieved if the shaping roller shapes the flange section of the workpiece by means of radial movement.

In particular, an effective flow of material in the inward direction can be achieved by advancing the shaping roller in the direction of the radial inner region of the workpiece, or in the direction of the axial shaped section. To this end, the shaped roller is first placed axially at the peripheral region of the workpiece and then moved inwardly in a radial direction. As a result of the inward displacement of material, the axial extent, that is to say, the thickness, of the radial outer region is reduced in the region acted upon.

The radial outer region of the workpiece is preferably supported along its circumferential side, in order to limit the outward flow of material. The support is preferably provided by means of an abutment, for example a ring, which restricts outward migration of material. The abutment preferably provides a stop for the peripheral region of the workpiece. As such, given the action of the shaping roller on the material, that material can, to a large extent, only move inwardly, and as a consequence, there takes place an effective flow of material in the direction of the drawing gap between the punch and the die, or in the direction of the transition border between the flange section and the axial shape section.

To prevent, as far as possible, any bulging of material in the radial outer region of the workpiece, the radial outer region of the workpiece is preferably held down by means of a depressing roller. The depressing roller is placed against the peripheral region of the workpiece and axially presses against it so as to impede any bulging in the axial direction. Unlike the shaping roller, the depressing roller preferably takes no active part in reshaping of the workpiece.

A particularly economical method involves reshaping the radial outer region of the workpiece on a pressing surface of the die. The die thus functions simultaneously as a reshaping tool for drawing the workpiece and as a drawing chuck for reshaping by means of the shaping roller. In this way the workpiece can be reshaped on the die by means of drawing or deep-drawing and at the same time by means of pressure rolling or spinning.

By drawing the radial inner region of the workpiece, a contour in the form, for example, of a bowl or a sleeve, can be shaped. To shape a sleeve-shaped contour, a central orifice is firstly formed in the workpiece, or a raw workpiece having a central orifice is used. The central orifice can be widened by drawing by means of the punch and the die. The drawing process enables expansion of the opening while reshaping, so that material is forced from the center so as to assume a larger diameter, by means of the drawing tool.

In a preferred embodiment of the method of the invention, the central region of the workpiece is stretch formed by means of a smoothing ring during the drawing process. In this way, while drawing, the wall thickness of the axial section can be efficiently reduced and the material can get an improved hardening. The shaping rollers, numbering at least one, supply the material necessary for smoothing and/or reshaping towards the drawing gap.

When reshaping the workpiece by means of the shaping roller, it is preferred that a defined structure be formed in the radial outer region of the workpiece. The pressing surface of the die preferably comprises for this purpose a corresponding, defined structure, into which the material is molded by means of the shaping roller. By "defined structure" are to be understood, in particular, ledges, notches, grooves, flutes, or gear teeth. In this way, the peripheral region of the workpiece is shaped in a particularly effective manner while drawing takes place. By the method, in the flange section of the workpiece can form-on, for example, radially directed, axial reinforcements.

The reliability of reshaping of the workpiece can be further improved by driving the punch into the matrix in a pulsating fashion. It is preferred, particularly in a very short time sequence, that after each advancing stroke there follows a short reverse stroke, in order to relieve the strain on the material. The combination of continuous movement of the shaping roller with pulsating movement of the punch during the pressing process leads to particularly efficient hardening and shaping of the material, particularly in the transition edge between the outer flange and the axial shape section. Furthermore, it reduces the force required for axially forming gear teeth by means of the punch.

In addition, incremental drawing or deep-drawing reduces the risk of the development of cracks in the workpiece.

In a further preferred embodiment of the method provision is made for the workpiece to be first predrawn with the punch, firstly at rest, that is to say, without rotation thereof and followed by the rotating workpiece and the action of the shaping roller there is the continuation of the drawing process. Predrawing without the action of the shaping roller allows for reliable centering of the workpiece and a reduction in the cycle time and respectively the reshaping time.

In a preferred embodiment, reshaping of the workpiece takes place, at least to a large extent, with retention of the diameter, that is to say, essentially without any reduction in the diameter. To this end, the radial outer region of the workpiece can for this purpose be appropriately fixed to the die.

It is preferred that the shaping roller is advanced to the punch in an interpolating manner.

Once the process of drawing has been accomplished, further reshaping steps are preferably used for post-shaping the workpiece, in particular by means of pressure rolling, spinning, smoothing, splitting, and/or profiling, while the workpiece being fixed in position between the die and the punch. For example, whilst on the device, the drawn region can be further shaped by means of at least one shaping roller. The region drawn can also be further shaped by at least one flow spinner, and the wall thickness can be at least partially reduced. At the same time the material that has been displaced can form external gear teeth.

In this way, preferably, multiple reshaping steps take place on one and the same machine with the workpiece remaining fixed between the die and the punch. Alternatively, or in addition to the fixing of the workpiece between the die and the punch, other supporting equipment may also be provided, should this be necessary.

With regard to the device, it is preferred that the die serves as a chuck for the shaping roller and that it has a ring-shaped pressing surface. The pressing surface extends in this case at right angles to the central axis of the workpiece or respectively perpendicular to the axis of rotation. The shaping roller can act on, or reshape, the peripheral region of the workpiece while it is on the pressing surface.

In order to shape a defined surface structure in the radial outer region of the workpiece, the die preferably comprises a pressing surface having an appropriate, defined structure. The structured pressing surface can comprise, for example, ledges, notches, grooves, flutes, gear teeth and so forth.

Furthermore, the die and/or the punch can have a corresponding, defined contour, in particular a polygonal contour and/or a profile, in order to shape a defined contour in the radial inner region of the workpiece. For example, the intake chamber of the die can comprise a defined inner contour, corresponding to the outer contour of the workpiece in the area of the axial shape section which contour is to be shaped. In order to shape a defined inner contour on the workpiece in the area of the axial shape section, the die can comprise an appropriate outer contour. In particular, the device of the invention can be configured for the manufacture of both shapes with rotational symmetry and shapes without this rotational symmetry. For example, a polygonal or corrugated axial shape section can be manufactured.

During the drawing process an inner and/or an outer shape, preferably a spline, can be shaped in the region drawn. In addition, during the method, a Hirth coupling can be shaped or embossed outside and/or inside, preferably in the hub or bowl region at the bottom, and/or in the region of the flange.

In order for the shaping roller to create an effective inward material flow, an abutment ring, in particular in one piece, is preferably supplied, which provides a stop surface to limit the outward material flow and/or serves to center the workpiece and/or to transmit torque to the workpiece. The abutment ring can also comprise several parts, where the individual parts or segments can then preferably be driven in a radial direction.

The die preferably includes a smoothing ring or stretch forming ring, for stretch forming the inner region of the workpiece when drawing. The smoothing ring can lead to thinning of the material while the axial segment of the workpiece is being drawn.

It is preferred, according to the present invention, that both the die and the punch be driven for rotation. A synchronization device is preferably provided, which synchronizes the rotational velocity of the die and the punch. Particularly precise reshaping is achieved by the rotational power of the die and the punch.

It is preferred that, in the device or during the process a separating agent, in particular a lubricant, be used, which facilitates the drawing process and the subsequent removal of the component. An emulsion can also be used as a separating agent, which makes for better heat removal during the process.

To avoid the development of creases a drawing ring can be used during the drawing process in order to retain the material. An extra roller can also be used to avoid the development of creases, as a back stop.

The device can preferably be equipped with an ejector and/or with automatic loading and unloading means.

Positioning of the punch and/or the shaping roller can be effected, preferably, by means of a path-controlled axle or power-controlled axle, in particularly by means of an interpolating path-controlled axle or power-controlled axle.

Using the method of the invention, it is further possible to shape a second, axially extending hub-shaped region, which can extend contrary to the region drawn. Shaping of the second hub can be achieved by means of, for example, spinning or splitting and/or by means of a chambered shaping roller. The use of sliding sleeve tools in order to shape a third hub in a single setup is also possible.

The method makes it possible to shape hubs having almost the same wall thickness as that of the source material.

The invention will be further described below with reference to preferred embodiments illustrated in the attached figures. In the drawings.

Figure 17:
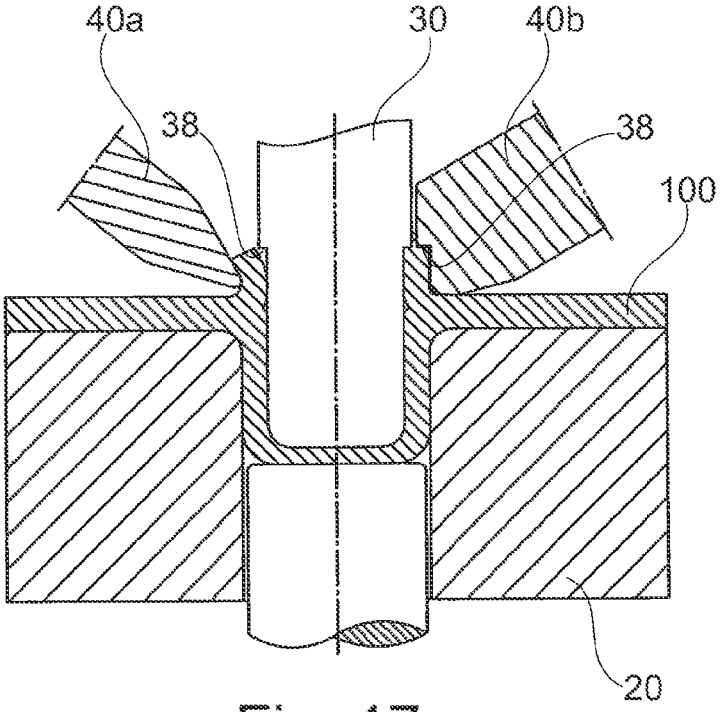
Figure 18:
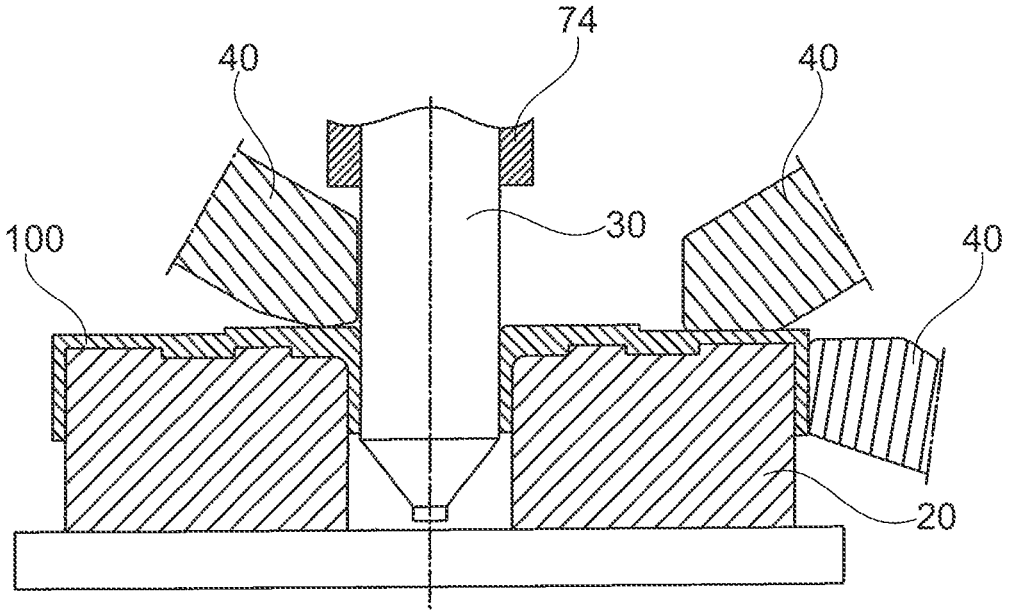
Figure 19:
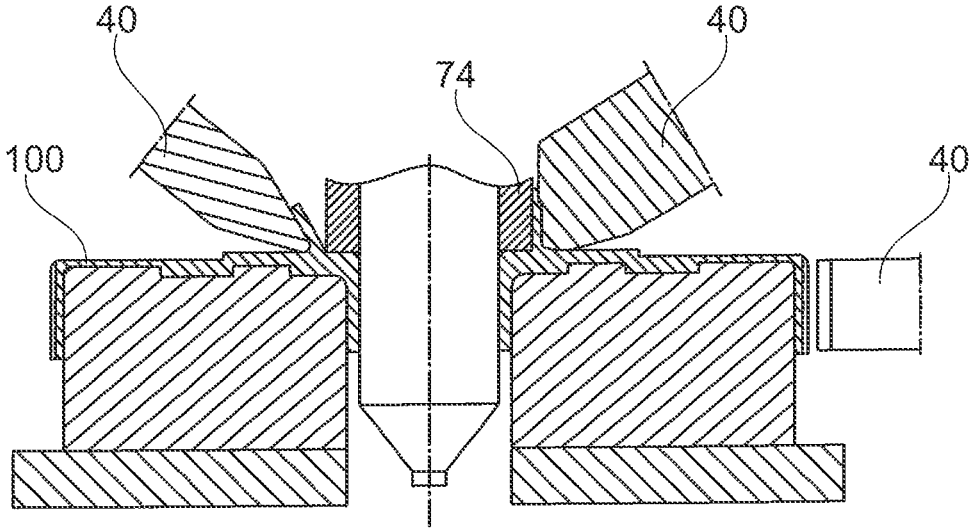
Figure 22:
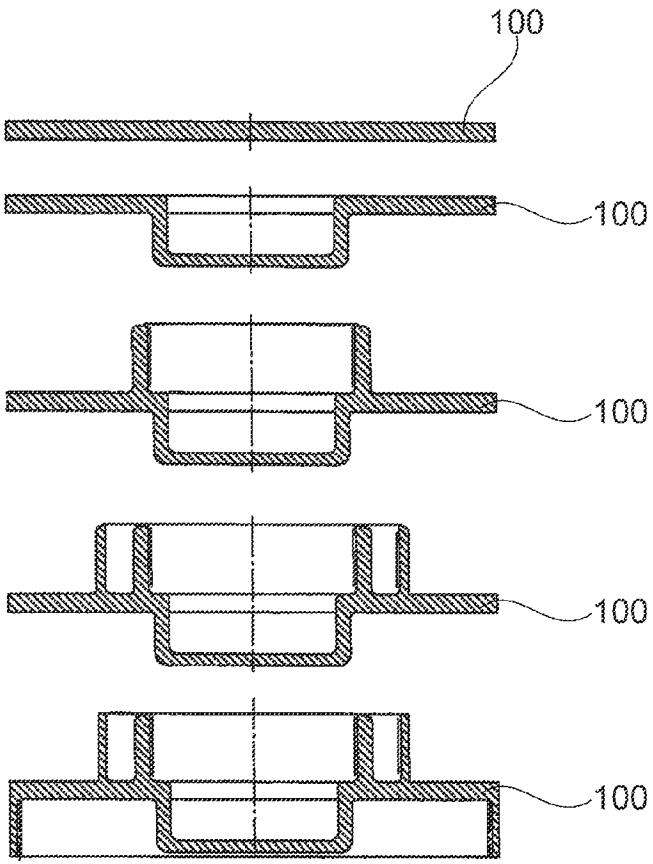
Figure 20:
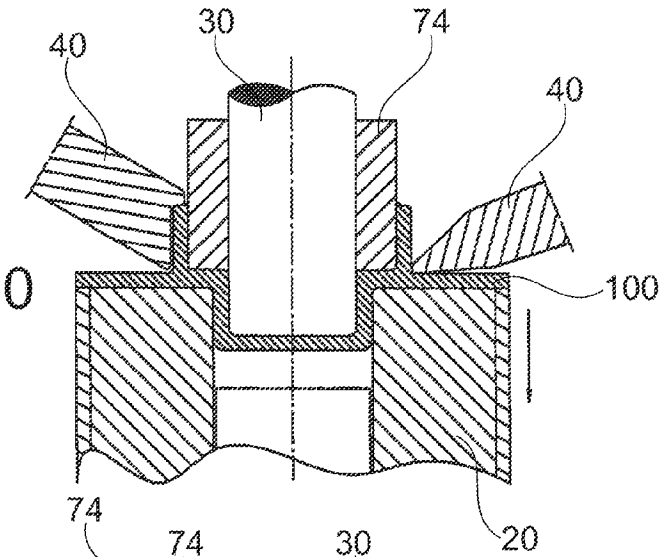
Figure 21:
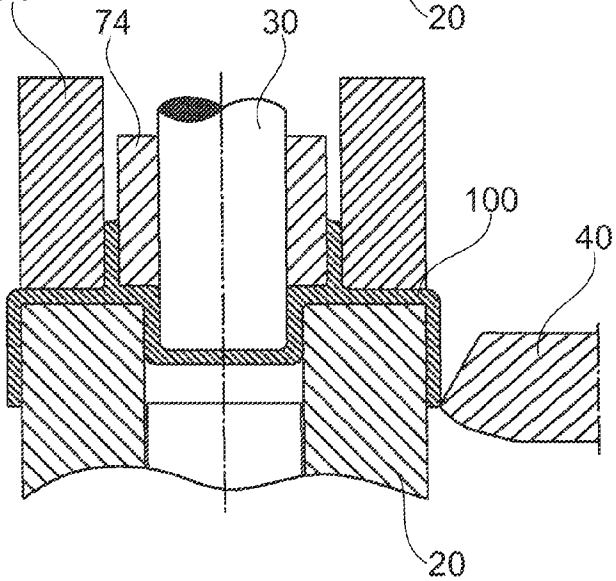
Figure 23:
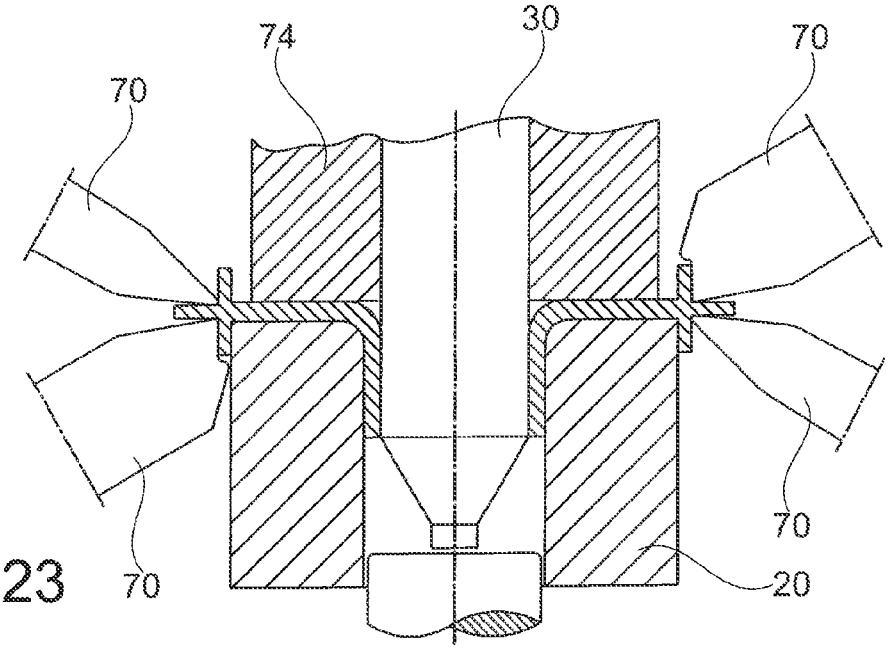
Figure 24:
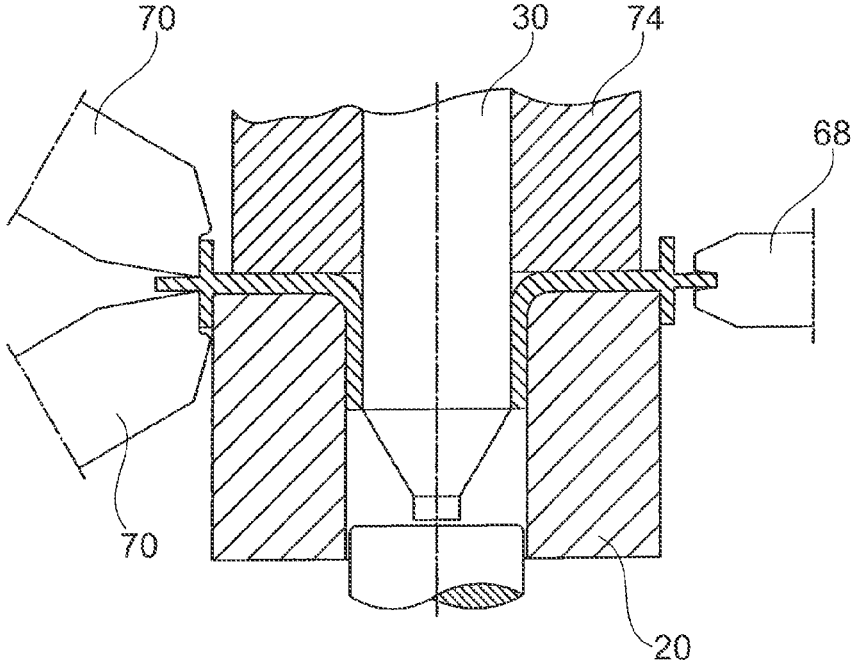
Figure 25:
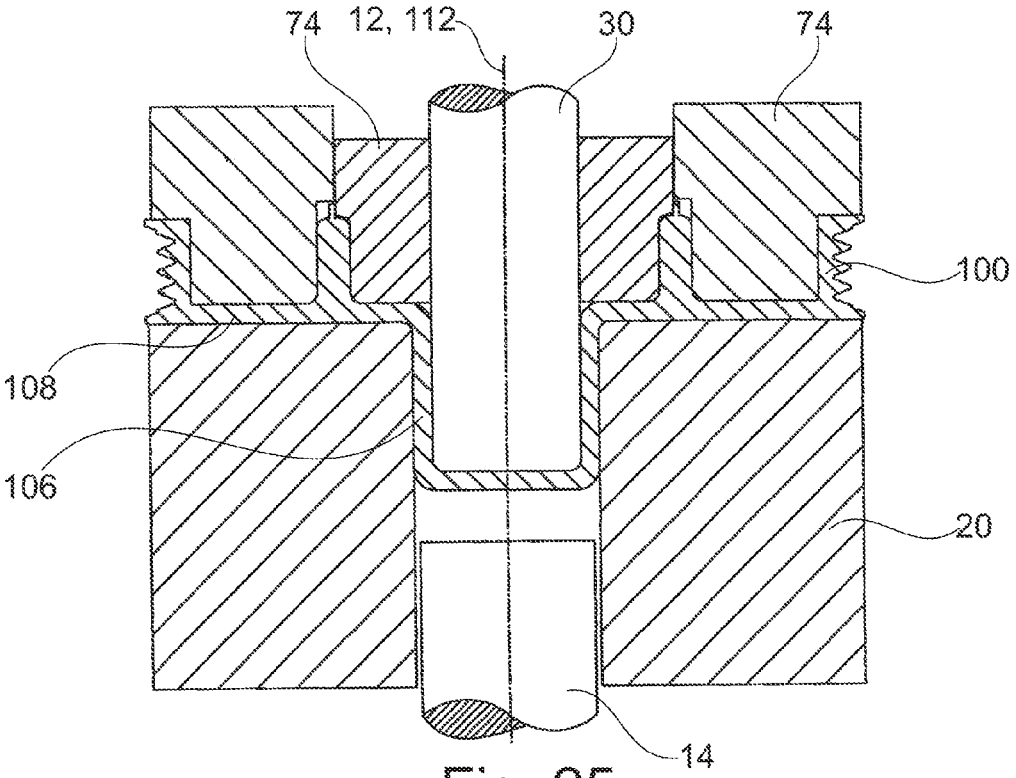
Figure 26:
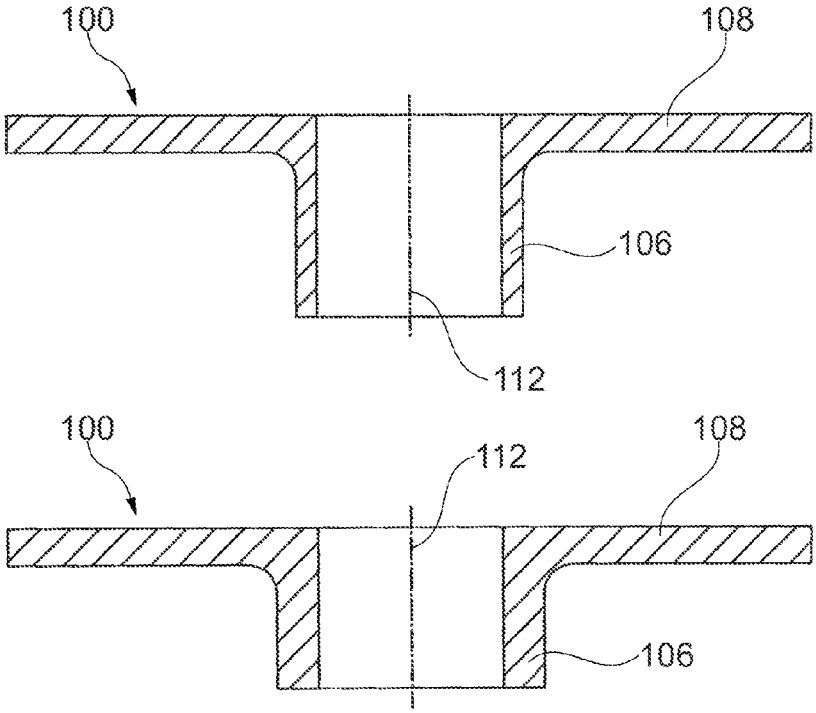

FIG. 17 a shows further embodiment of a reshaping device and a reshaping method;

FIG. 18 a shows further embodiment of a reshaping device and a reshaping method;

FIG. 19 shows a further embodiment of a reshaping device and a reshaping method;

FIG. 20 shows a further embodiment of a reshaping device and a reshaping method;

FIG. 21 shows a further embodiment of a reshaping device and a reshaping method;

FIG. 22 shows reshaping steps for the manufacture of a complex component;

FIG. 23 shows a further embodiment of a reshaping device and a reshaping method;

FIG. 24 shows a further embodiment of a reshaping device and a reshaping method;

FIG. 25 shows a further embodiment of a reshaping device and a reshaping method;

FIG. 26 illustrates a reshaping step for upsetting a hub, and

Figure 27:
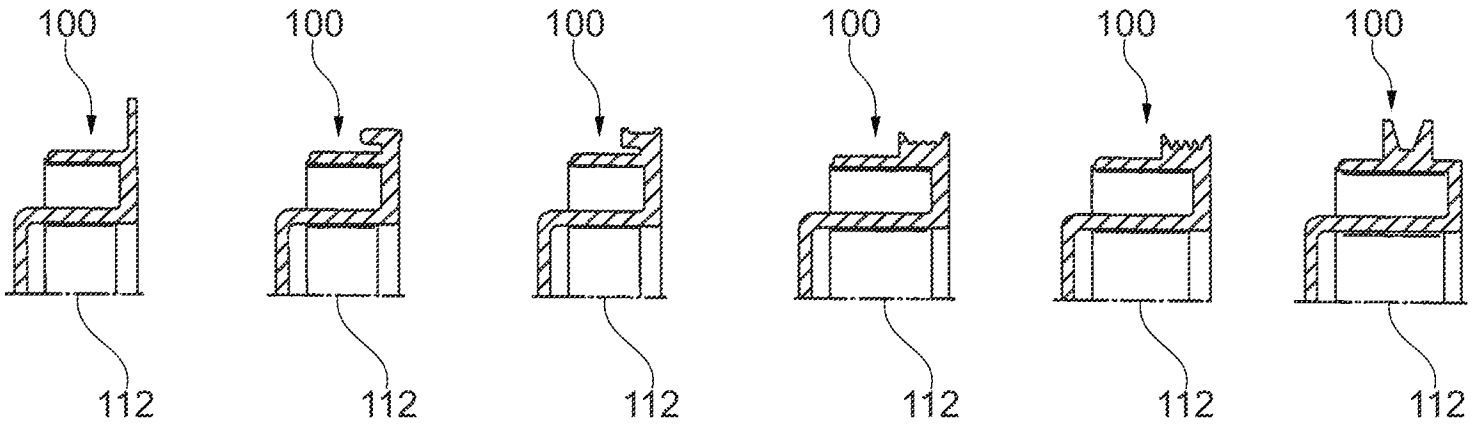

FIG. 27 shows diverse components and intermediate shapes, which may be manufactured by means of the reshaping process of the invention and the reshaping device of the invention.

In all figures, identical or equivalent components are denoted by the same reference numerals. The aspects of the invention clarified with reference to the figures can basically be freely combined with one another and are not to be understood as mutually exclusive alternatives.

Figures 1, 2:
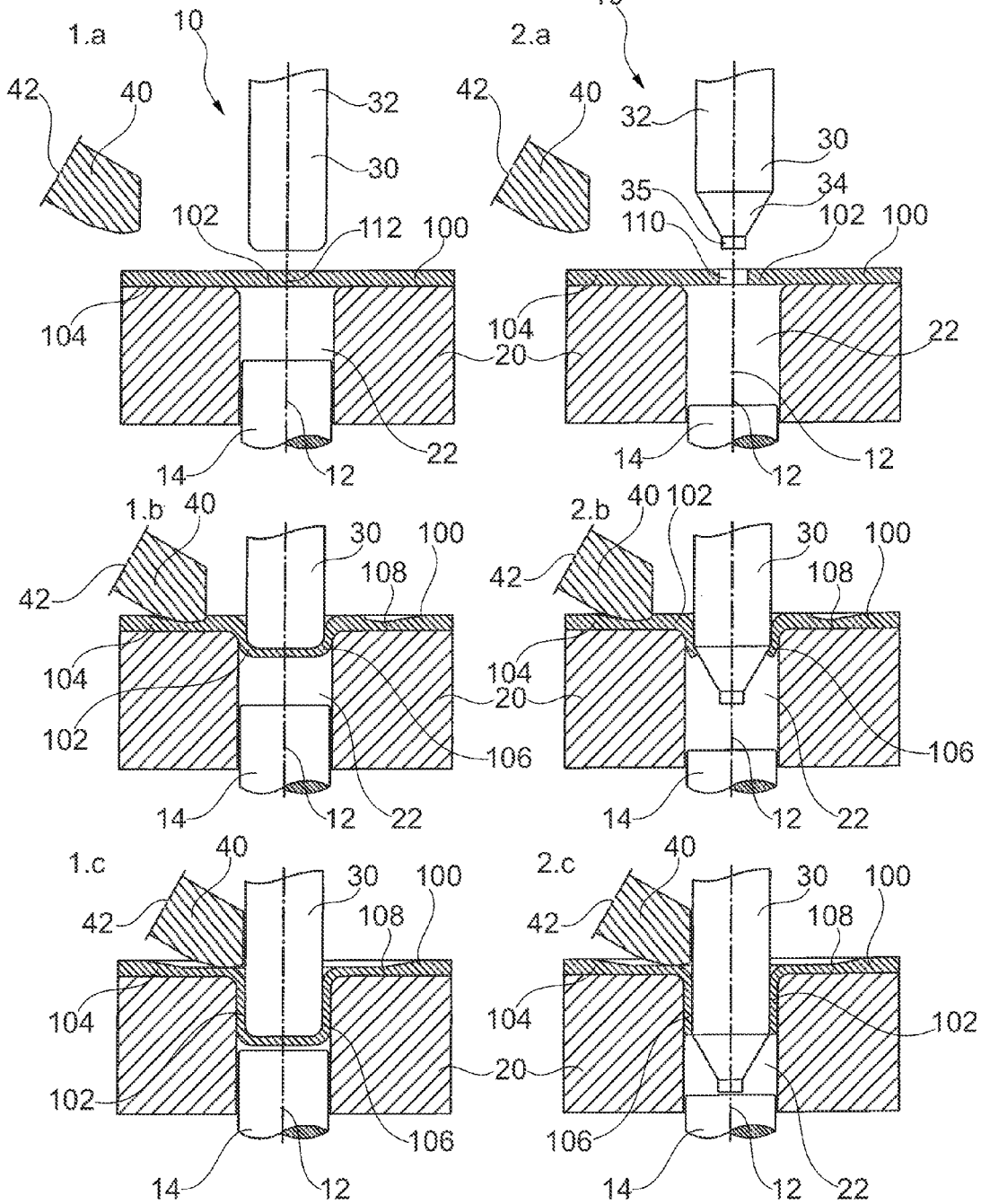
FIG. 1 shows a first embodiment of a reshaping device and a reshaping method.
FIG. 2 shows a further embodiment of a reshaping device and a reshaping method.

FIGS. 1 and 2 show fundamental aspects of the method of the invention and of the device 10 of the invention, illustrated as an example of non-cutting shaping a bowl or a hub from a preferably substantially rotationally symmetrical workpiece 100, for example a round sheet metal blank or a preshaped blank.

The device 10 for reshaping the workpiece 100 comprises a die 20 having a roughly central intake orifice 22, into which a punch 30 can be moved linearly in an axial direction. The die 20 and the punch 30 are so adjusted to each other that a drawing gap is formed between them, into which an inner region 102 of the workpiece 100 is drawn when the punch 30 is driven into the die 20.

The die 20 and the punch 30 are mounted and can be driven for rotation about a rotational axis 12 on a machine bed (not shown). The workpiece 100 can be positioned on the die 20 and can also be caused to rotate thereabout. The workpiece 100 may also be centered on the die 20 and during reshaping is held in position by the die 20 and the punch 30. To achieve particularly effective reshaping, the punch 30 can be driven in a revolution or angle of revolution synchronous manner additionally to the rotation of the die.

Furthermore, the device 10 includes one or more shaping rollers 40, adjusted such that they are advanced axially and/or radially in a substantially radially extending outer region 104 of the workpiece 100, while the inner region 102 of the workpiece 100 is reshaped by means of the punch 30 and the die 20. The at least one shaping roller 40 is mounted for rotation about a rotational axis 42, which axis is preferably perpendicular to, or at an angle to, the rotational axis 12. The die 20 comprises a pressing surface 24, which also substantially extends at right angles to the rotational axis 12, and is mounted on a shaft 14.

In order to reshape the workpiece 100, it is placed on the die 20. The punch 30 is driven axially along the rotational axis 12 or coaxial to the rotational axis 12 in the direction of the die 20, such that the workpiece 100 is clamped between the die 20 and the punch 30. The die 20 and the punch 30 are set in rotation about the rotational axis 12, which at the same time forms the central axis 112 of the workpiece. The workpiece 100 is also set in rotation by means of the die 20.

On further axial advancing of the punch 30, it is driven into the free space or intake orifice 22 of the die 20 and draws the workpiece 100 into a drawing gap formed between the die 20 and the punch 30, so as to create an axial shape section 106 and a radial flange section 108. The punch 30 and the die 20 are disposed and moved centrically or in a coaxial fashion relatively to each other. The drawing punch 30 exerts pressure and/or drawing tension on the workpiece 100.

A shaping roller 40 is moved to the radial outer region 104 of the workpiece at the same time as the workpiece 100 is drawn, and this shaping roller actively creates a flow of material from the radial outer region 104 in the direction of the radial inner region 102. In the region shaped, material is moved in a radial and/or axial direction by the shaping roller 104, and an axial thickness of the region 104 is reduced. The shaping roller 40 moves material in particular radially inward and guides it to the drawing gap. To this end, the shaping roller 40 is preferably driven radially inwardly, as can be seen from FIGS. 1.*b* and 1.*c*, and 2.*b* and 2.*c*.

Using the shaping roller 40, in particular a pressure roller or a flow spinner, pressure strain and/or drawing strain is exerted on the workpiece 100 to be shaped. This strain or these strains aids or aid in the flow of material during the reshaping process of the punch 30.

Thus, the workpiece 100 is reshaped through a combination of a deep-drawing method and an axial and/or radial flow spinning method.

FIG. 1 illustrates a method of the invention and components of the device of the invention for reshaping, as an example, a workpiece 100 in the form of a round sheet metal blank, so as to form a component having an axial shape section 106 in the form of a bowl shaped inner region. The punch 30 has preferably a substantially cylindrical shape having a cylindrical outer surface 32.

FIG. 2 shows an embodiment of the method of the invention with reference to the reshaping of a workpiece 100 substantially in the form of a round sheet metal blank having a central orifice 110, this workpiece being shaped into a component having an axial shape section 106 in the form of a sleeve-shaped inner region. In this case the punch 30 comprises an approximately conical section 34 for widening the workpiece 100 and an insertion section 35 used for inserting and centering the workpiece 100. The insertion section 35 is first introduced into the central orifice 110 of the workpiece 100. Thereafter the punch 30 is driven into the intake orifice 22 and the workpiece 100 is drawn into the drawing gap between the die 20 and the punch 30, widening the central orifice 110. While the workpiece 100 is being drawn, analogous to the embodiment shown in FIG. 1 a shaping roller 40 acts on the radial outer region 104, creating in this way a targeted flow of material in the direction of the drawing gap.

Figure 3:
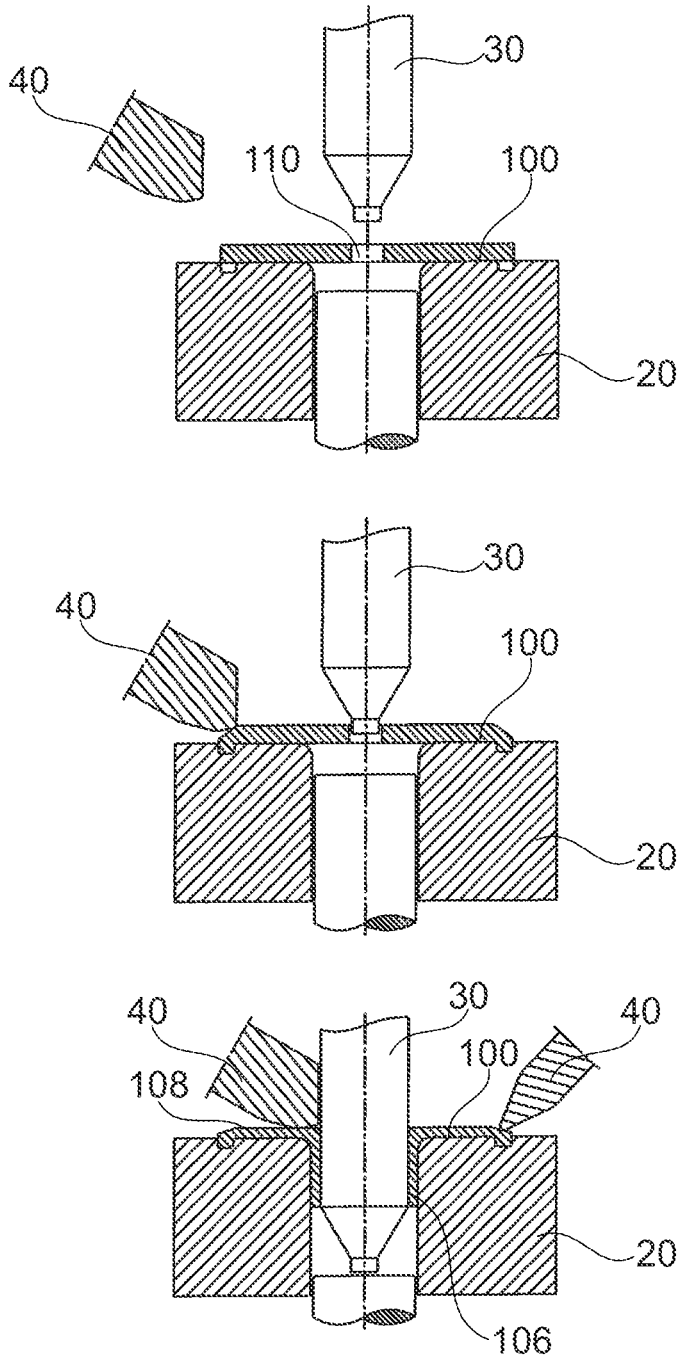
FIG. 3 shows a further embodiment of a reshaping device and a reshaping method.

FIG. 3 shows an embodiment of the method, wherein the workpiece 100 is pre-shaped by the shaping roller 40 before being shaped by drawing of the radial inner region 102, and wherein the workpiece 100 is centered on the die 20. The centering is achieved by pressing the workpiece 100 into a contour of the die 20. In the example shown the peripheral region of the workpiece 100 is pressed into an annular groove in the die 20.

The workpiece 100 is fixed to the die 20 in the radial direction, by preliminary shaping of the radial outer region 104 of the workpiece 100. In consequence, during the next step of the reshaping process involving drawing the workpiece 100 by means of the die 20 and punch 30, the radial extent of the workpiece 100 remains unchanged, thanks to the profile of the region 104 extending along the direction of the perimeter. This leads to the development of particularly strong drawing forces while the workpiece 100 is being drawn, which drawing forces, in the absence of the action on the radial outer region 104 during drawing reshaping, would mean the loss of the centering and/or a considerable risk of breaking of the workpiece 100.

Figure 4:
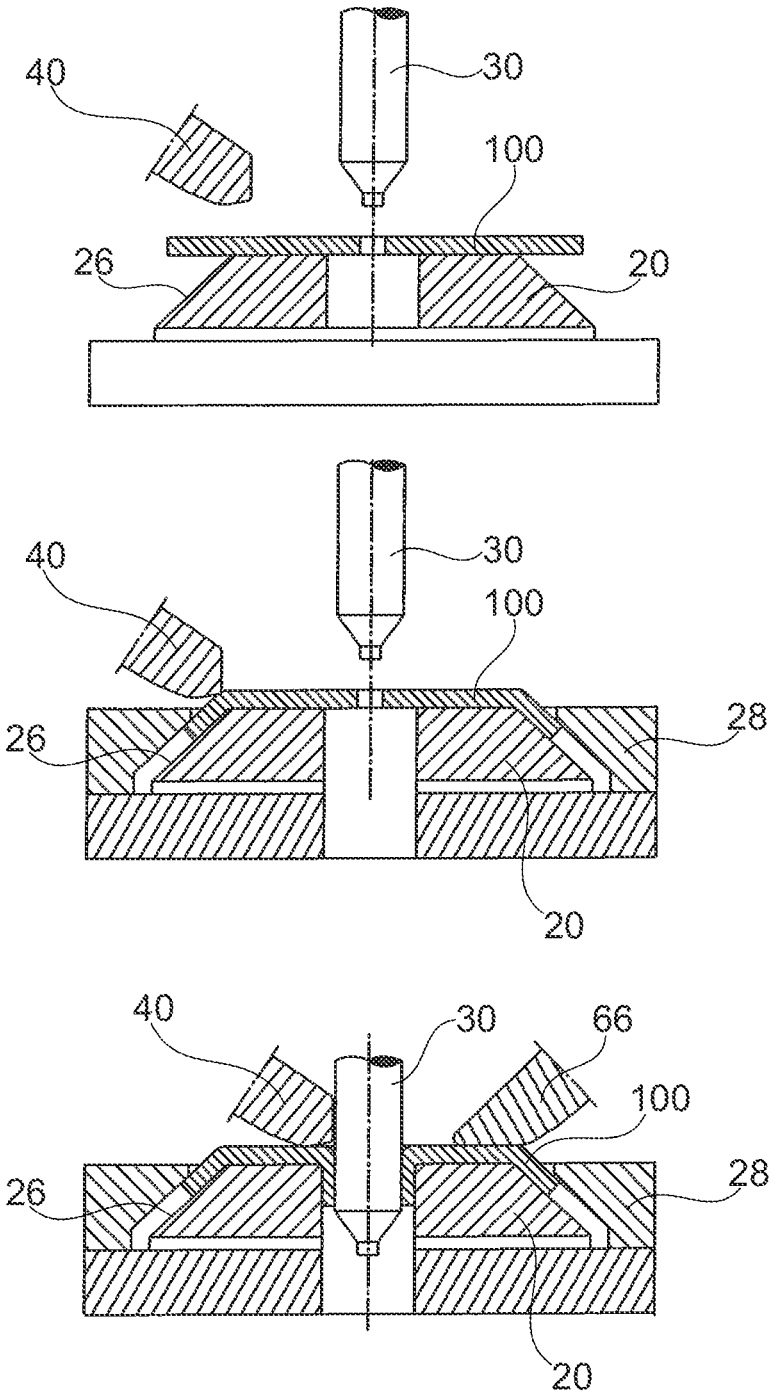
FIG. 4 shows a further embodiment of a reshaping device and a reshaping method.

FIG. 4 shows a further possibility of fixing the workpiece to the die 20. In the variant illustrated in FIG. 4, the die 20 has an outer circumferential region 26, which is at an angle relative to an inner surface section, on which section the workpiece 100 lies. By means of the shaping roller 40, the workpiece 100 is forced toward the outer contour region 26 of the die 20, creating a kink running along a roughly ring-shaped path. The workpiece 100 can then be fixed by means of a hold-down ring 28, with the workpiece 100 being clamped between the die 20 and the hold-down ring 28. Thereafter the radial inner region 102 of the workpiece 100 is shaped by drawing, as described above, while at the same time the shaping roller 40 acts on and reshapes the radial outer region 104.

The lower illustration in FIG. 4 shows, in addition to the shaping roller 40, a depressing roller 66, which holds down the workpiece 100 in the axial direction and prevents the workpiece 100 or the material from lifting.

Figure 5:
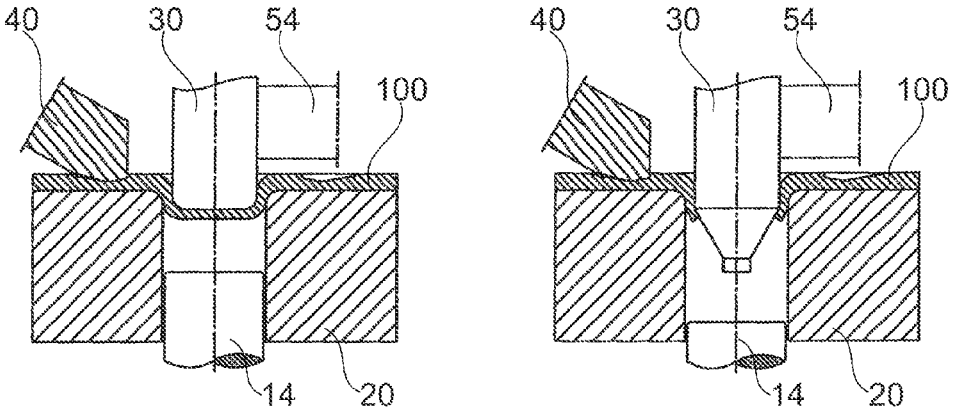
FIG. 5 shows a further embodiment of a reshaping device and a reshaping method.

FIG. 5 corresponds substantially to the illustrations in FIGS. 1.*b* and 2.*b*, in which the punch 30 is in addition supported by an supporting roller 54. The supporting roller 54 is mounted for rotation substantially parallel to the punch 30, and bears against a peripheral surface of the punch 30. It is also possible for a number of supporting rollers 54 to be distributed arranged in the peripheral direction around the punch 30.

Figure 6:
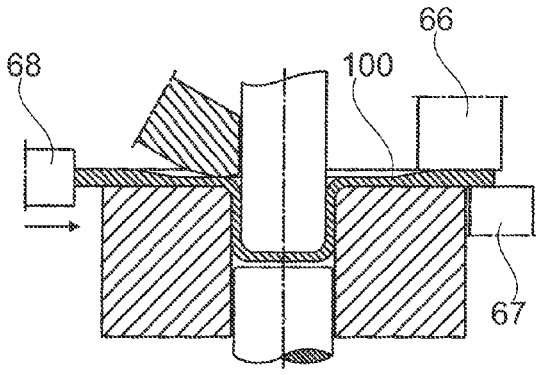
FIG. 6 shows a further embodiment of a reshaping device and a reshaping method.
Figure 7:
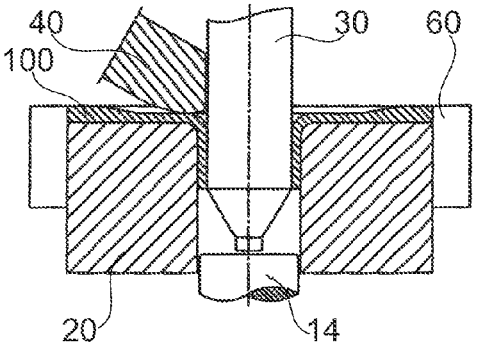
FIG. 7 shows a further embodiment of a reshaping device and a reshaping method.
Figure 8:
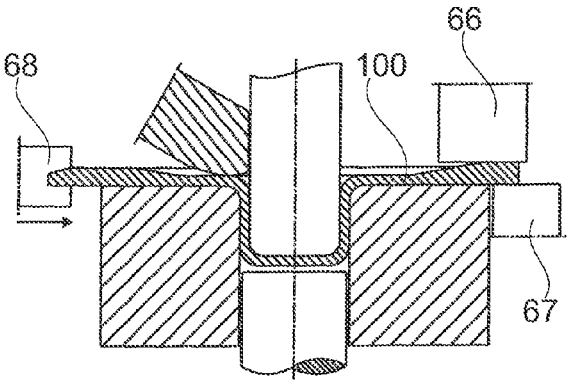
FIG. 8 shows a further embodiment of a reshaping device and a reshaping method.

FIGS. 6 to 8 show possibilities of limiting or preventing, and/or supporting a material flow in the outward direction when reshaping the outer region 104.

In FIG. 6 shows a pressure roller 68 disposed radially outside the shaping roller 40, which pressure roller presses the workpiece 100 radially inwardly. In this way an outward flow of material is prevented and, due to the effect of the shaping roller 40, a material flow is created that takes place almost exclusively radially inwardly. This makes it possible to support the radial flow of material as a result of radial displacement caused by the roller 68. The use of the rollers 66 and 67 as a pair prevents or minimizes axial lifting of the material in the outer region 104.

FIG. 7 shows a supporting ring 60 disposed around the workpiece 100 to prevent an outward flow of material. An outer circumferential region of the workpiece 100 bears against said supporting ring 60.

FIG. 8 shows a further embodiment of a pressure roller 68, which, differing from that illustrated in FIG. 6, exhibits a chambering which fixes the workpiece 100 in the axial direction and/or can be used for desired thickening of the outer radial region 104.

FIGS. 6 and 8 further show a repressing roller 66 above the workpiece 100 and a counter-roller 67 on a side of the workpiece 100 opposite the depressing roller 66, beside the die 20. Further, the rollers 66 and 67 can limit the axial material flow in the region 104.

Figure 9:
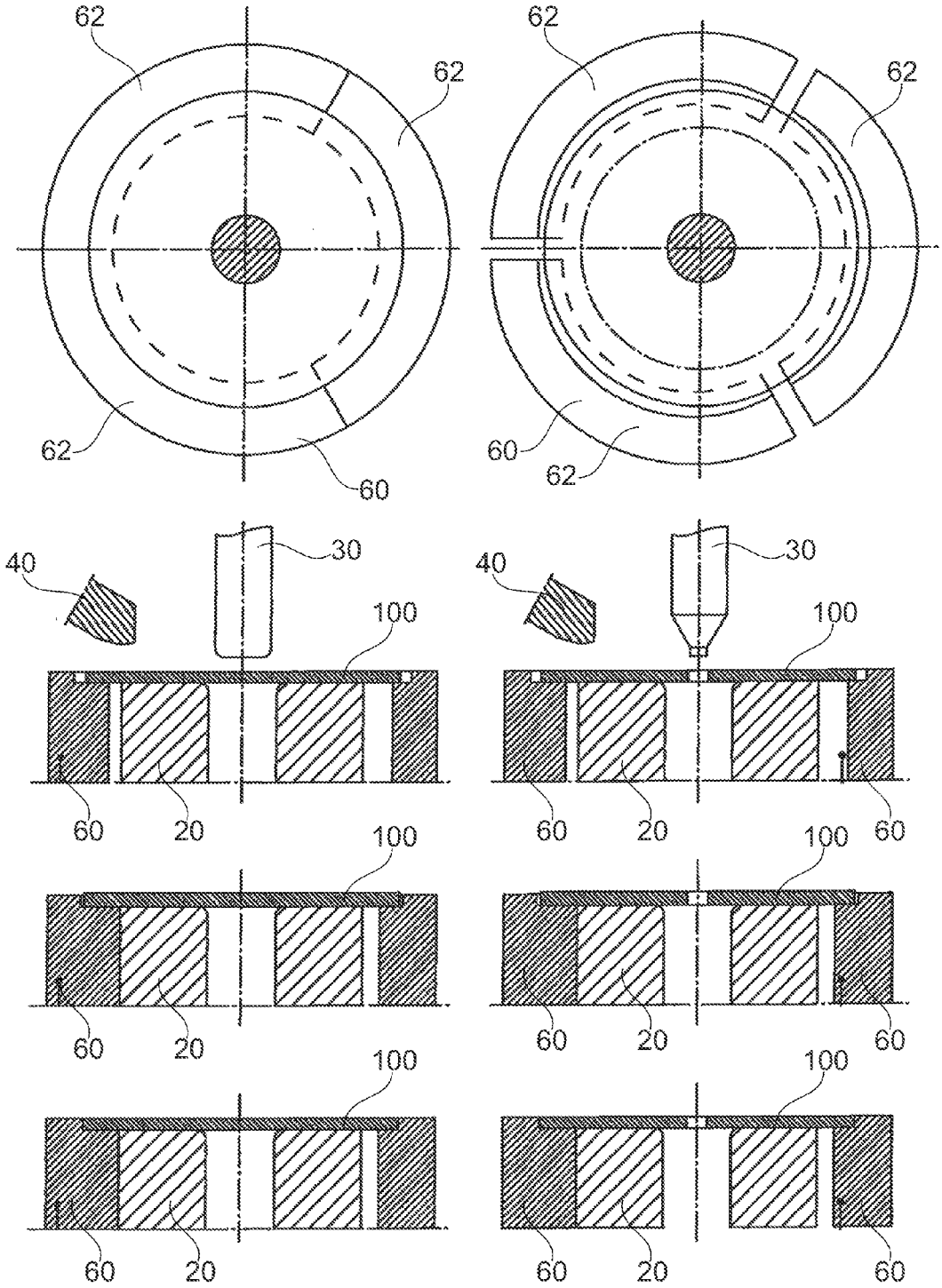
FIG. 9 shows a further embodiment of a reshaping device and a reshaping method.

FIG. 9 illustrates an embodiment of a supporting ring 60. This supporting ring 60 contains multiple ring segments 62, which are disposed in such a way that they can be moved radially. By moving the ring segments 62 radially inwardly, the workpiece 100 can be fixed or braced, as shown in the corresponding lower illustrations of FIG. 9.

Figure 10:
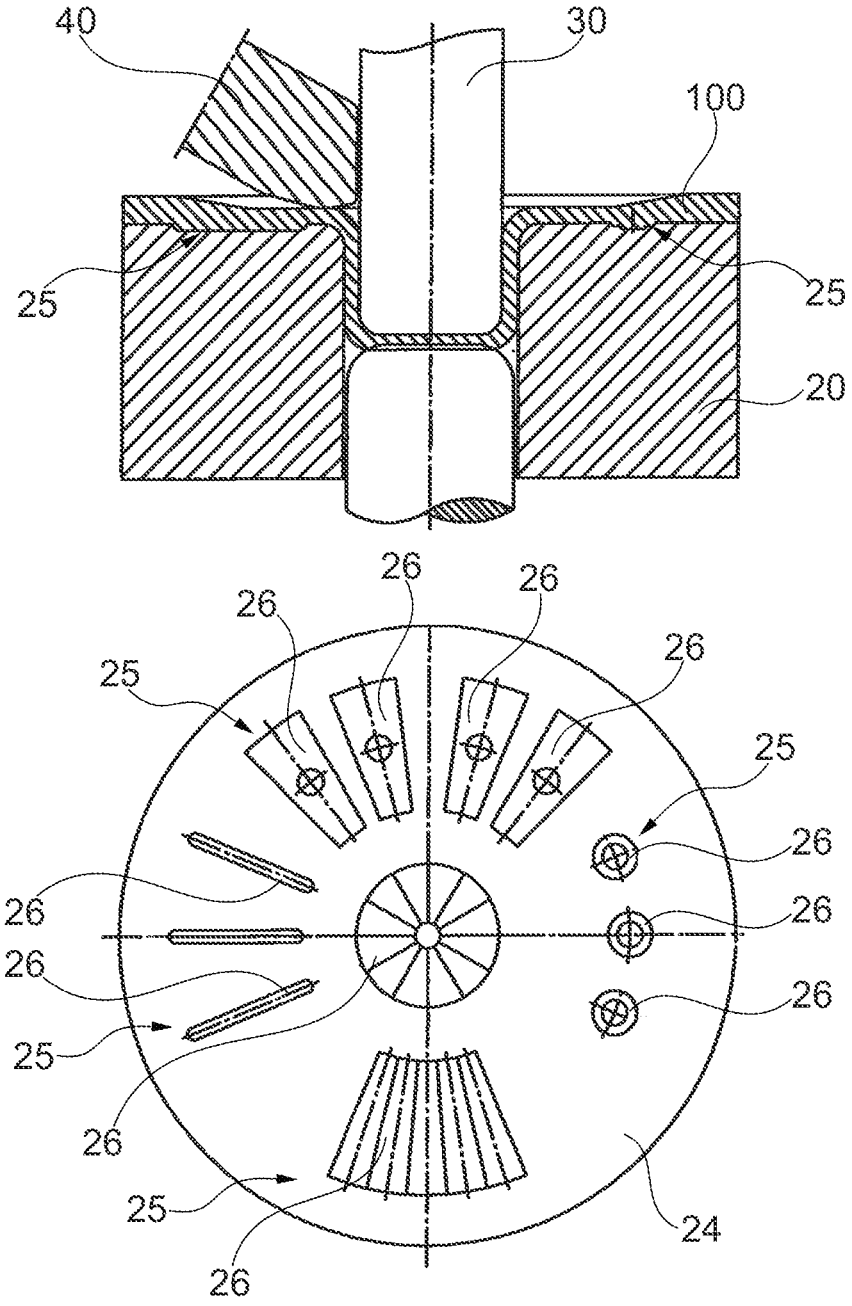
FIG. 10 shows a further embodiment of a reshaping device and a reshaping method.

FIG. 10 illustrates a possibility of introducing a defined structure into the radial outer region 104 of the workpiece 100. The die 20 contains, to this end, a correspondingly defined structure 25 on its pressing surface 24 with multiple structure elements, for example for shaping stiffener ribs, reinforcement points, or gear teeth on the radial outer region 104 of the workpiece 100. The structure elements can in principle be disposed at will, where an arrangement that is not rotationally symmetrical is also possible.

Figure 12:
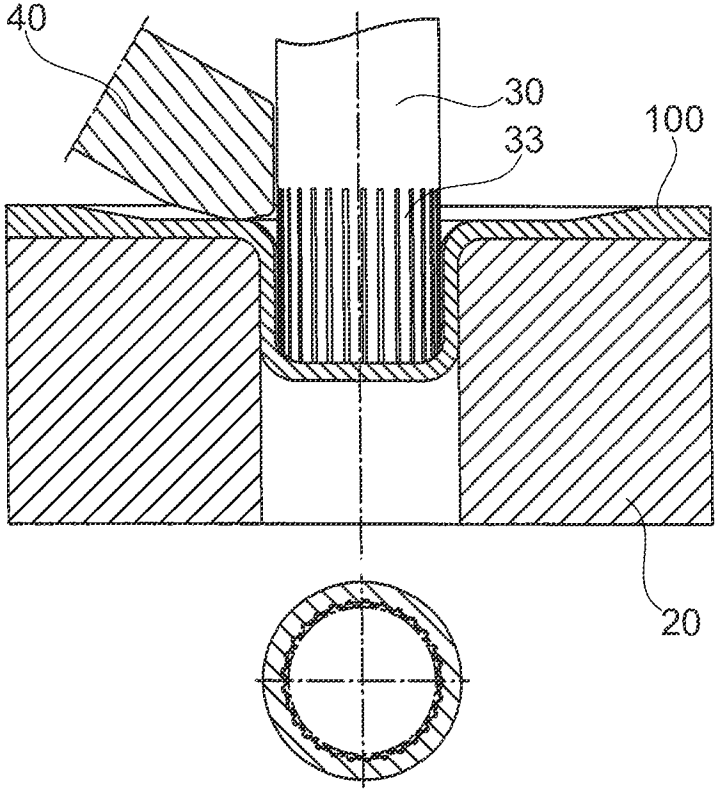
FIG. 12 shows a further embodiment of a reshaping device and a reshaping method.
Figure 11:
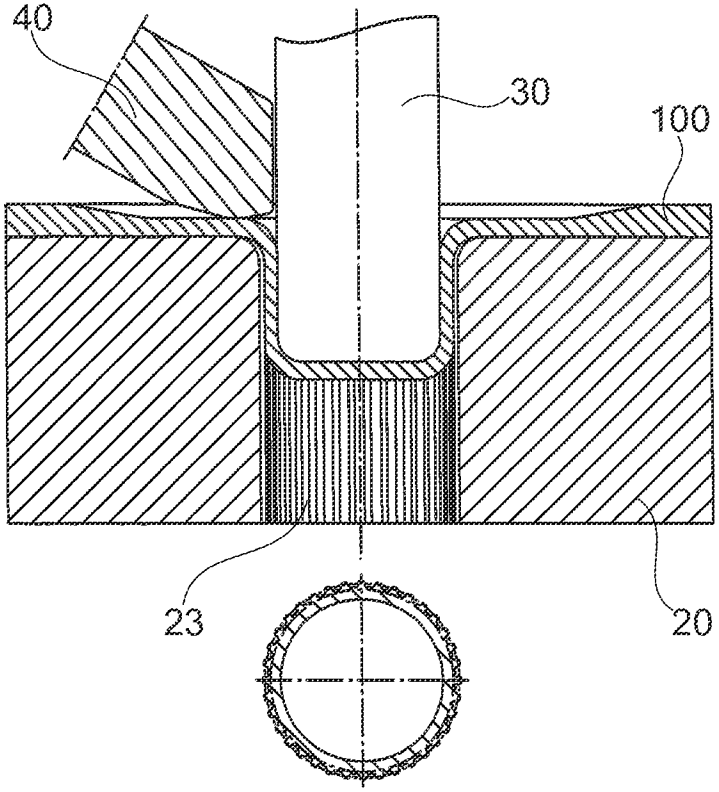
FIG. 11 shows a further embodiment of a reshaping device and a reshaping method.
Figure 13:
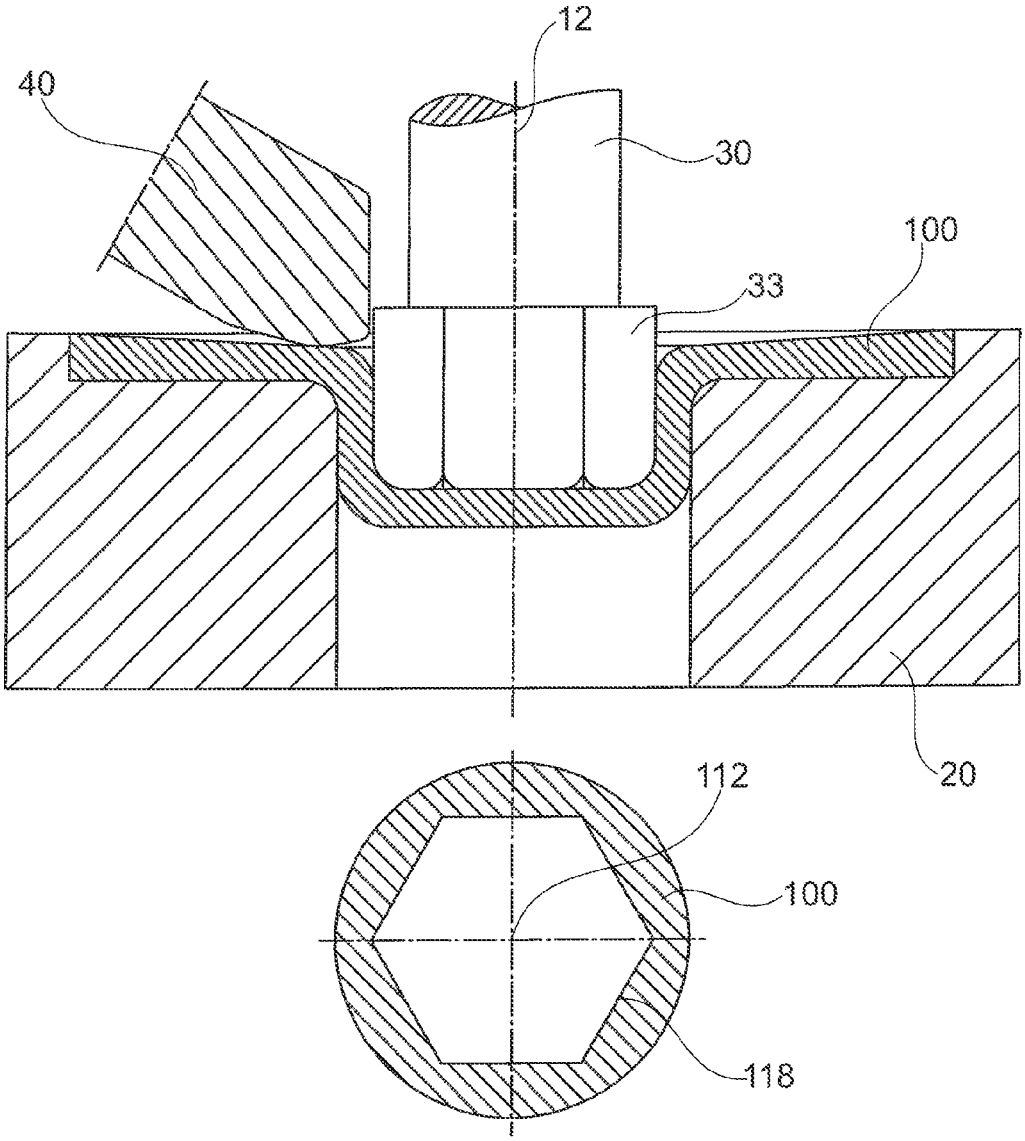
FIG. 13 shows a further embodiment of a reshaping device and a reshaping method.

FIGS. 11 to 13 show possibilities of shaping a contour or profile in the radial inner region 102 of the workpiece 100. In FIG. 11, the die 20 has a defined contour 23 at its intake orifice 22 in the form of a profile, into which the material is pressed during the drawing operation, so that a profiled or corrugated axial section of the workpiece 100 can be shaped. In a similar manner, the punch 30 in FIG. 12 has a structured outer contour 33, by means of which a structured region can be introduced into the axial section of the workpiece 100. As illustrated in FIG. 13, polygonal contours 118 can for example also be shaped in the axial section of the workpiece 100. The active subsequent movement of material caused by the shaping roller 40 allows a particularly precise shaping of such contours and reliably prevents rupture of the workpiece 100.

Figure 14:
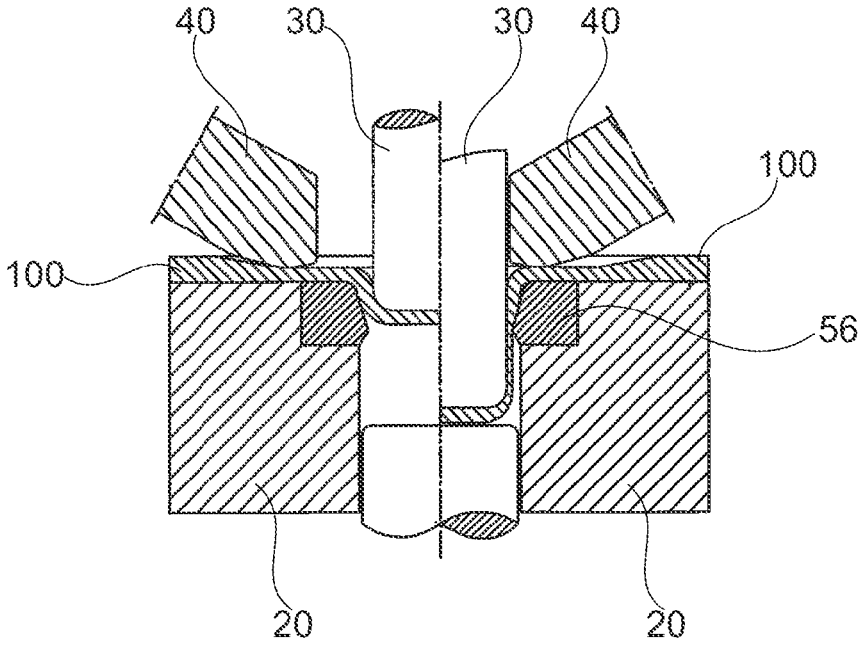
FIG. 14 shows a further embodiment of a reshaping device and a reshaping method.

FIG. 14 illustrates a variation of the method during which the material is smoothed while being drawn. In this way the thickness of the material in the region drawn or in the axial section 106 of the workpiece 100 can be reduced to a preferred value. A smoothing ring 56 is present in the die 20 and surrounds the intake orifice 22 in a ring-shaped manner and comprises a smoothing section having a diameter that is smaller than that of the intake orifice 22. The left-hand side of FIG. 14 illustrates a stage of the method at the beginning of the reshaping process, and the right-hand side a stage of the method at which the drawing process has been completed.

Figure 15:
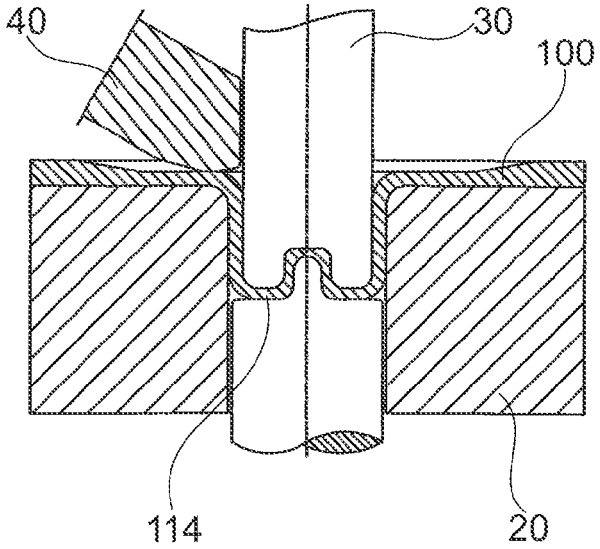
FIG. 15 shows a further embodiment of a reshaping device and a reshaping method.

FIG. 15 shows an embodiment where the shaft 14 or the off-pusher is designed as a counterpunch. A floor section 114 can be shaped as contour in the drawing region of the workpiece 100 by drawing or pressing the workpiece 100 between the punch and the off-pusher or counterpunch. The punch 30 and counterpunch each include to this end an axial abutting face, which corresponds to the contour of the finally shaped workpiece 100.

Figure 16:
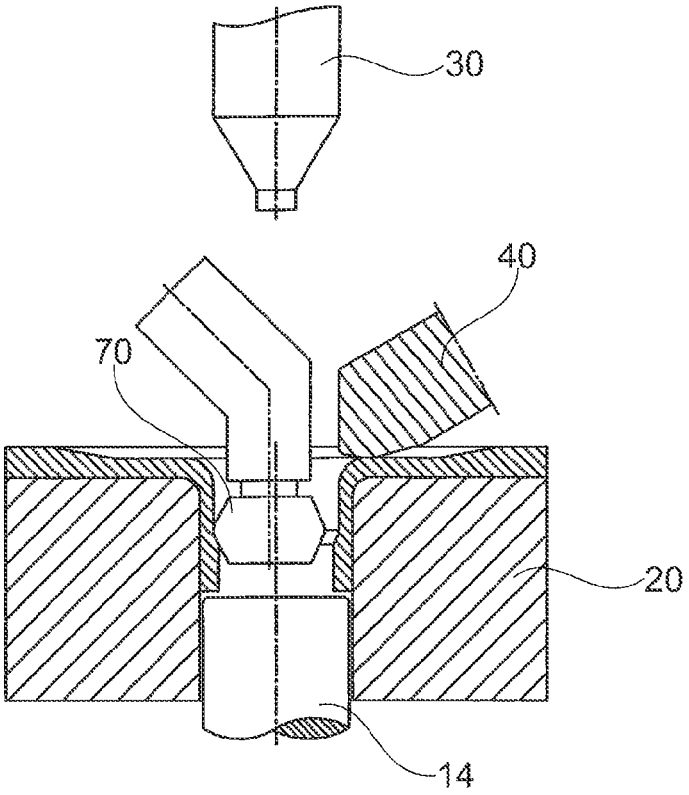
FIG. 16 shows a further embodiment of a reshaping device and a reshaping method.

FIGS. 16 to 27 show further steps in the reshaping process, which can in particular be carried out following the drawing process carried out. Here, FIG. 16 shows an embodiment in which the workpiece 100 remains between the die 20 and the punch 30 following the drawing process, and the punch is withdrawn. By the use of a post-shaping roller 70, which in this case is in the form of an inner roller, the axial section 106 of the workpiece 100 can be post-shaped, in particular it can be smoothed. This reduces the internal diameter of the axial shape section 106. At the same time the shaping roller 40 can act, as illustrated, on the radially outer section 104 of the workpiece 100, in order to push more material into the axial shape section 106.

FIG. 17 shows a possibility of shaping a second axial shape section 106 on that side of the workpiece 100 axially opposed to the axial shape section 106. To this end, while the workpiece 100 is fixed in position between the die 20 and the punch 30 and after the drawing process, further material is slided from the radial outer region 104 inwardly by means of preferably one shaping roller 40*a*, 40*b*, and shaped on the punch 30. As shown in FIG. 17, the punch and/or the shaping roller 40*a*, 40*b* can exhibit a chambering 38. The shaping rollers 40*a*, 40*b* can in principle also be the same shaping roller 40 as used during the drawing process.

FIGS. 18 and 19 illustrate the use of a sliding sleeve 74 for further increasing the flexibility of the method and to allow the manufacture of complex components. The sliding sleeve 74 is disposed in annular configuration about the punch 30 and is capable of sliding in an axial direction relatively to the punch 30. The sliding sleeve 74 can be retracted during the drawing process in order to allow the shaping roller 40 to be moved so as to bear against the punch 30, in order to cause material to be effectively moved radially inwardly towards the drawing gap. On conclusion of the drawing process, the sliding sleeve 74 can be moved axially towards and against the workpiece, creating a mandrel for a second axial section, as illustrated in FIG. 19. The radial dimension of the sliding sleeve 74 here can basically be chosen largely at will, so that different shapes of the workpiece 100 can be manufactured.

It is basically also possible to provide multiple sliding sleeves and to employ them one after the other, in order to manufacture complex components, such as, for example, illustrated in FIG. 22. It is possible, for example, to use an inner sliding sleeve to begin with, followed by an outer sliding sleeve in order to shape further axial shape sections 106. A further increase in flexibility with regard to the components to be shaped can be achieved by a design of the die 20 in multiple parts, or preferably at least one part can be slided, as illustrated in FIGS. 20 and 21, enabling further reshaping in the outer radial region 104.

FIGS. 23 and 24 illustrate further post-shaping steps to allow shaping an outer region of the workpiece 100. Here the die 20 and a sliding sleeve 74 function as mandrels, against the periphery of which material is pressed.

FIG. 25 shows a complex component that can be manufactured by means of the method of the invention. Various sliding sleeves 74 are used for the purpose of shaping multiple hub sections.

FIG. 26 illustrates upsetting of a hub of a workpiece 100 following manufacture of the hub by means of drawing and simultaneous reshaping of the flange section 108.

FIG. 27 shows further examples of components that can be manufactured by reshaping a workpiece 100 by means of the method of the invention and the device of the invention.

All in all, the method of the invention and the device of the invention enable particularly flexible and reliable reshaping of a, in particular round sheet metal blank-shaped workpiece 100. Complex components can be produced economically and without metal cutting.

The invention claimed is:

1. A method for reshaping a workpiece, the workpiece having a central axis, a radial inner region and a radial outer region, in which the radial inner region of said workpiece is reshaped by a punch and a die by a drawing process effected in the axial direction so that an axial material flow is caused along the central axis such that an axial shaped section is formed, resulting in an edge being formed between the axial shaped section and the radially-directed radial outer region, wherein during the forming of the axial shaped section by the drawing process, said workpiece is caused to rotate about its central axis and while rotating, said radially-directed radial outer region of said workpiece is subjected to the action of at least one shaping roller to aid the axial material flow by the drawing process such that a wall thickness in the radially-directed radial outer region is reduced by displacing material and the displaced material is caused to flow radially in the direction of the radial inner region of said workpiece into the edge between the axial shaped section and the radially-directed radial outer region.

2. A method as claimed in claim 1, wherein said shaping roller is advanced in the direction of the radial inner region of said workpiece.

3. A method as claimed in claim 1, wherein said radially-directed radial outer region of said workpiece is peripherally supported for limiting a flow of material directed in the outward direction.

4. A method as claimed in claim 1, wherein said radially-directed radial outer region of said workpiece is depressed by means of at least one depressing roller.

5. A method as claimed in claim 1, wherein said radially-directed radial outer region of said workpiece is reshaped on the pressing surface of said die.

6. A method as claimed in claim 1, wherein during the drawing process said radial inner region of said workpiece is stretch formed by means of a smoothing ring.

7. A method as claimed in claim 1, wherein during the procedure of reshaping said workpiece by means of the shaping roller a defined structure is formed in the radially-directed radial outer region of said workpiece.

8. A method as claimed in claim 1, wherein said punch is inserted in said die in a pulsating manner.

9. A method as claimed in claim 1, wherein said shaping roller is advanced to said punch in an interpolating manner.

10. A method as claimed in claim 1, wherein on completion of the drawing process further reshaping steps are carried out by means of spinning, flow forming, stretch flow forming, splitting, and/or profiling, the workpiece being fixed in position between the die and the punch.

11. A device for reshaping a workpiece, the workpiece having a central axis, a radial inner region and a radial outer region, for carrying out the method as claimed in claim 1, the device comprising:

a die and a punch for reshaping the radial inner region of said workpiece by a drawing process effected in the axial direction so that an axial material flow is caused along the central axis thus forming an axial shaped section, resulting in an edge being formed between the axial shaped section and the radially-directed radial outer region;

mounting means for mounting the die and the punch for rotation during the drawing process;

means for rotating the workpiece about its central axis during the forming of the axial shaped section by the drawing process; and at least one shaping roller acting on the radially-directed outer region of the workpiece for aiding the axial material flow while the workpiece is rotating during the drawing process, so that a wall thickness in the radially-directed outer region is reduced by displacing material; and the displaced material is caused to flow radially in the direction of the radial inner region of said workpiece into the edge between the axial shaped section and the radially-directed outer region.

12. A device as claimed in claim 11, wherein said die forms a spinning chuck for said shaping roller and has an annular pressing surface.

13. A device as claimed in claim 11, wherein for shaping a defined structure in said radial outer region of said workpiece said die comprises a pressing surface having an appropriately defined structure.

14. A device as claimed in claim 11, wherein said die and/or said punch are provided with an appropriately defined contour, in particular with a polygonal contour and/or profiling for the purpose of forming a defined contour in the radial inner region of said workpiece.

15. A device as claimed in claim 11, wherein a supporting ring comprising one or more parts is provided which presents outwards a stop surface for restricting a flow of material for an external periphery of said workpiece and/or serves to center said workpiece and/or to apply torque to said workpiece.

16. A device as claimed in claim 11, wherein said die comprises a smoothing ring for stretch forming the radial inner region of said workpiece during the drawing operation.

17. A device as claimed in claim 11, wherein both the die and the punch can be driven for rotation.

* * * * *